US007482048B2

(12) United States Patent
Boutghrit et al.

(10) Patent No.: US 7,482,048 B2
(45) Date of Patent: Jan. 27, 2009

(54) COMPOSITE THERMOPLASTIC SHEETS INCLUDING AN INTEGRAL HINGE

(75) Inventors: Lahoussaine Boutghrit, Breda (NL); Diederik Adrianus Maria van Oevelen, Bergen op Zoom (NL)

(73) Assignee: Azdel, Inc., Forest, VA (US)

( * ) Notice: Subject to any disclaimer, the term of this patent is extended or adjusted under 35 U.S.C. 154(b) by 415 days.

(21) Appl. No.: 11/112,651

(22) Filed: Apr. 22, 2005

(65) Prior Publication Data

US 2006/0240235 A1 Oct. 26, 2006

(51) Int. Cl.
*B32B 3/00* (2006.01)

(52) U.S. Cl. ..... 428/58; 428/33; 428/60; 428/61

(58) Field of Classification Search ..... 428/58, 428/60, 62, 61, 317.9, 318.4, 318.6, 318.8, 428/33, 52, 54
See application file for complete search history.

(56) References Cited

U.S. PATENT DOCUMENTS

| | | | | |
|---|---|---|---|---|
| 4,235,952 | A * | 11/1980 | Holmes et al. | 428/60 |
| 4,390,384 | A * | 6/1983 | Turner | 156/221 |
| 4,670,331 | A | 6/1987 | Radvan et al. | |
| 4,734,321 | A | 3/1988 | Radvan et al. | |
| 5,009,747 | A | 4/1991 | Viazmensky et al. | |
| 5,093,171 | A * | 3/1992 | Sheahan | 428/61 |
| 5,151,320 | A | 9/1992 | Homonoff et al. | |
| 5,322,724 | A * | 6/1994 | Levens | 428/57 |
| 5,338,059 | A | 8/1994 | Inoue | |
| 5,437,919 | A * | 8/1995 | Welich et al. | 442/224 |
| 5,641,554 | A | 6/1997 | Koizumi | |
| 5,685,560 | A | 11/1997 | Sugiyama et al. | |
| 5,839,752 | A | 11/1998 | Yamasaki et al. | |
| 5,845,929 | A | 12/1998 | Schlett et al. | |
| 5,979,931 | A | 11/1999 | Totani et al. | |
| 6,042,140 | A | 3/2000 | Blazaitis et al. | |
| 6,287,678 | B1 | 9/2001 | Spengler | |
| 6,762,138 | B2 | 7/2004 | Ferreira et al. | |
| 6,841,028 | B2 * | 1/2005 | Tsukada et al. | 156/304.6 |

FOREIGN PATENT DOCUMENTS

| | | |
|---|---|---|
| EP | 0 319 589 B1 | 11/1995 |
| WO | WO 96/12849 | 5/1996 |
| WO | WO 03035435 A1 * | 5/2003 |

OTHER PUBLICATIONS

U.S. Appl. No. 62/157,782, filed Jun. 26, 1987, Goto, Fumio.

* cited by examiner

*Primary Examiner*—N. Edwards
(74) *Attorney, Agent, or Firm*—Armstrong Teasdale LLP

(57) ABSTRACT

A composite thermoplastic sheet includes, in an exemplary embodiment, a permeable core layer having a first surface and an opposing second surface. The core layer includes a plurality of reinforcing fibers bonded together with a first thermoplastic material. The composite sheet also includes a flexible thermoplastic skin laminated to and covering at least a portion of the first surface of the core layer. The core layer includes about 20 weight percent to about 80 weight percent reinforcing fibers.

13 Claims, 2 Drawing Sheets

COMPOSITE THERMOPLASTIC SHEETS INCLUDING AN INTEGRAL HINGE

BACKGROUND OF THE INVENTION

This invention relates generally to porous fiber reinforced thermoplastic polymer sheets, and more particularly to porous fiber reinforced thermoplastic polymer sheets that include an integral hinge area.

Porous fiber reinforced thermoplastic sheets have been described in U.S. Pat. Nos. 4,978,489 and 4,670,331 and are used in numerous and varied applications in the product manufacturing industry because of the ease of molding the fiber reinforced thermoplastic sheets into articles. Known techniques, for example, thermo-stamping, compression molding, vacuum forming, and thermoforming have been used to successfully form articles from fiber reinforced thermoplastic sheets.

Some articles require portions of the fiber reinforced thermoplastic sheets to be subjected to sharp bends during the stamping or molding process. Also some articles, such as automotive instrument panels with integral airbag doors require a hinge to permit the airbag door to open during deployment of the airbag. Known techniques for providing a hinge function in a thermoplastic sheet includes steel inserts, plastic clips and glued-on plastic support skins. These known techniques increases article costs, fabrication equipment costs, and manufacturing complexity.

BRIEF DESCRIPTION OF THE INVENTION

In one aspect, a composite thermoplastic sheet is provided. The composite thermoplastic sheet includes a permeable core layer having a first surface and an opposing second surface. The core layer includes a plurality of reinforcing fibers bonded together with a first thermoplastic material. The composite thermoplastic sheet also includes a flexible thermoplastic skin laminated to and covering at least a portion of the first surface of the core layer. The core layer includes about 20 weight percent to about 80 weight percent reinforcing fibers.

In another aspect, a method of fabricating a composite thermoplastic sheet is provided. The method includes the steps of forming a permeable core layer including a plurality of reinforcing fibers bonded together with a first thermoplastic material, heating the core layer to a temperature sufficient to melt the first thermoplastic material, positioning a first flexible thermoplastic skin on at least a portion of a first surface of the core, and laminating the flexible thermoplastic skin to the core layer to form a laminate structure.

In another aspect, a composite article is provided. The composite article includes a permeable core layer including a first thermoplastic material and a plurality of reinforcing fibers. The core layer includes a first surface and an opposing second surface. The composite article also includes a hinge area that includes a first flexible thermoplastic skin laminated to at least a portion of the first surface of the core layer.

DETAILED DESCRIPTION OF THE INVENTION

A composite thermoplastic sheet that includes an integrated hinge function area is described below in detail. The composite thermoplastic sheet includes a low-density thermoplastic core containing reinforcing fibers and at least one flexible skin made from an elastomer material laminated to the core. The composite thermoplastic sheet with integrated hinge function can be used in parts in the automotive, transportation, leisure, construction, and agricultural vehicle industries. Composite thermoplastic sheets with integrated hinge function can be used in a number of vehicle part applications, for example, loadfloors, parcel trays, and airbag areas.

Figure 1:
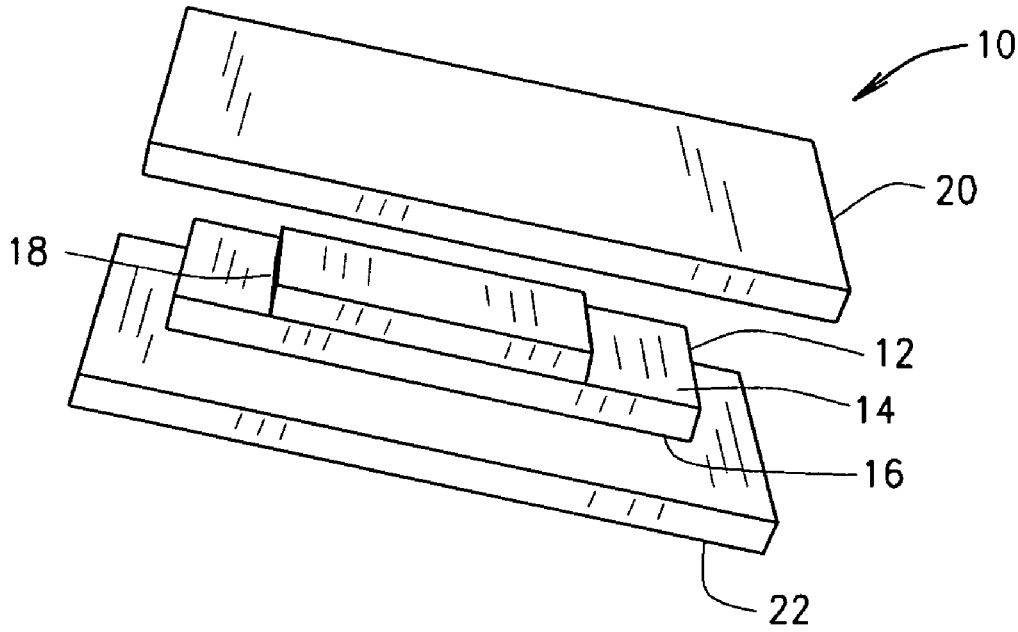
FIG. 1 is an exploded perspective schematic illustration of a composite thermoplastic sheet in accordance with an embodiment of the present invention.
Figure 2:
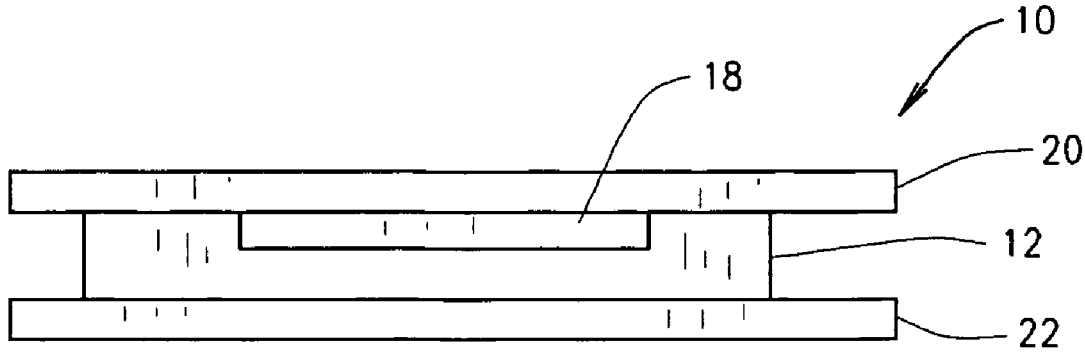
FIG. 2 is a schematic end illustration of the composite thermoplastic sheet shown in FIG. 1.

Referring to the drawings, FIG. 1 is an exploded perspective schematic illustration of an exemplary composite thermoplastic sheet 10 and FIG. 2 is a schematic end illustration of composite thermoplastic sheet 10. Referring to FIGS. 1 and 2, composite thermoplastic sheet 10 includes a porous core 12 having a first surface 14 and a second surface 16. A flexible skin 18 is laminated to first surface 14 of core 12. A first decorative skin 20 is bonded to first surface 14 and a second decorative skin 22 is bonded to second surface 16. In alternate embodiments, composite sheet 10 includes only one decorative skin or no decorative skins.

Core 12 is formed from a web made up of open cell structures formed by random crossing over of reinforcing fibers held together, at least in part, by one or more thermoplastic resins, where the void content of porous core 12 ranges in general between about 1% and about 95% and in particular between about 30% and about 80% of the total volume of core 12. In another embodiment, porous core 12 is made up of open cell structures formed by random crossing over of reinforcing fibers held together, at least in part, by one or more thermoplastic resins, where about 40% to about 100% of the cell structure are open and allow the flow of air and gases through. Core 12 has a density in one embodiment of about 0.1 gm/cc to about 1.8 gm/cc and in another embodiment about 0.3 gm/cc to about 1.0 gm/cc. Core 12 is formed using known manufacturing process, for example, a wet laid process, an air laid process, a dry blend process, a carding and needle process, and other known process that are employed for making non-woven products. Combinations of such manufacturing processes are also useful.

Core 12 includes about 20% to about 80% by weight of reinforcing fibers having an average length of between about 5 mm and about 50 mm, and about 20% to about 80% by weight of a wholly or substantially unconsolidated fibrous or particulate thermoplastic materials, where the weight percentages are based on the total weight of core 12 In another embodiment, core 12 includes about 30% to about 55% by weight of reinforcing fibers. In another embodiment, core 12 includes reinforcing fibers having an average length of between about 5 mm and about 25 mm. Suitable fibers include, but are not limited to metal fibers, metalized inorganic fibers, metalized synthetic fibers, glass fibers, graphite fibers, carbon fibers, ceramic fibers, mineral fibers, basalt fibers, inorganic fibers, aramid fibers, kenaf fibers, jute fibers, flax fibers, hemp fibers, cellulosic fibers, sisal fibers, coir fibers, and mixtures thereof.

In the exemplary embodiment, reinforcing fibers having an average length of about 5 mm to about 50 mm is added with thermoplastic powder particles, for example polypropylene powder, to an agitated aqueous foam which can contain a surfactant. The components are agitated for a sufficient time to form a dispersed mixture of the reinforcing fibers and thermoplastic powder in the aqueous foam. The dispersed mixture is then laid down on any suitable support structure, for example, a wire mesh, and then the water is evacuated through the support structure forming a web. The web is dried and heated above the softening temperature of the thermoplastic powder. The web is then cooled and pressed to a predetermined thickness to produce composite core 12 having a void content of between about 1 percent to about 95 percent.

The web is heated above the softening temperature of the thermoplastic resins in core 12 to substantially soften the plastic materials and is passed through one or more consolidation devices, for example calendaring rolls, double belt laminators, indexing presses, multiple daylight presses, autoclaves, and other such devices used for lamination and consolidation of sheets and fabrics so that the plastic material can flow and wet out the fibers. The gap between the consolidating elements in the consolidation devices are set to a dimension less than that of the unconsolidated web and greater than that of the web if it were to be fully consolidated, thus allowing the web to expand and remain substantially permeable after passing through the rollers. In one embodiment, the gap is set to a dimension about 5% to about 10% greater than that of the web if it were to be fully consolidated. A fully consolidated web means a web that is fully compressed and substantially void free. A fully consolidated web would have less than 5% void content and have negligible open cell structure.

Particulate plastic materials include short plastics fibers which can be included to enhance the cohesion of the web structure during manufacture. Bonding is affected by utilizing the thermal characteristics of the plastic materials within the web structure. The web structure is heated sufficiently to cause the thermoplastic component to fuse at its surfaces to adjacent particles and fibers.

In one embodiment, individual reinforcing fibers should not on the average be shorter than about 5 millimeters, because shorter fibers do not generally provide adequate reinforcement in the ultimate molded article. Also, reinforcing fibers should not on average be longer than about 50 millimeters since such fibers are difficult to handle in the manufacturing process.

In one embodiment, in order to confer structural strength the reinforcing fibers have an average diameter between about 7 and about 22 microns. Fibers of diameter less than about 7 microns can easily become airborne and can cause environmental health and safety issues. Fibers of diameter greater than about 22 microns are difficult to handle in manufacturing processes and do not efficiently reinforce the plastics matrix after molding.

In one embodiment, the thermoplastics material used to form core 12 is, at least in part, in a particulate form. Suitable thermoplastics include, but are not limited to, polyolefins, including polymethylene, polyethylene, and polypropylene, polystyrene, acrylonitrylstyrene, butadiene, polyesters, including polyethyleneterephthalate, polybutyleneterephthalate, and polypropyleneterephthalate, polybutyleneterachlorate, and polyvinyl chloride, both plasticised and unplasticised, acrylics, including polymethyl methacrylate, and blends of these materials with each other or other polymeric materials. Other suitable thermoplastics include, but are not limited to, polyarylene ethers, acrylonitrile-butylacrylate-styrene polymers, amorphous nylon, as well as alloys and blends of these materials with each other or other polymeric materials. It is anticipated that any thermoplastics resin can be used which is not chemically attacked by water and which can be sufficiently softened by heat to permit fusing and/or molding without being chemically or thermally decomposed.

The thermoplastic particles need not be excessively fine, but particles coarser than about 1.5 millimeters are unsatisfactory in that they do not flow sufficiently during the molding process to produce a homogenous structure. The use of larger particles can result in a reduction in the flexural modulus of the material when consolidated.

Flexible skin 18 is formed from an elastomeric material having a low tensile modulus, for example, less than about 2500 Mpa, and having a high tensile elongation to failure, for example, greater than about 50 percent elongation. Suitable elastomeric materials include, but are not limited to, thermoplastic elastomers, thermoplastic urethanes, silicones, polyolefins, for example, polypropylene and polyethylene, polycarbonates, and mixtures thereof.

Flexible skin 18 is laminated to core 12 by any known lamination technique. In one embodiment, core 12 is heated to the melting temperature of the thermoplastic material in core 12. Flexible skin 18 is positioned on first surface 14 of heated core 12 and then pressure is applied to laminate flexible skin 18 to core 12 by , for example, nip rollers, double belt laminators, indexing presses, multiple daylight presses, autoclaves, and other such devices used for lamination. In one embodiment, flexible skin 18 is sized to cover only a portion of first surface 12, and in another embodiment, flexible skin 18 is sized to cover the entire area of first surface 12.

The size and position of flexible skin 18 on core 12 is selected to provide a predetermined area that has a hinge function to permit bending of composite sheet 10 in the predetermined area. The ability of composite sheet 10 to bend in the hinge area permits composite sheet 10 to be molded into various shapes that can include deep draw sections and bent sections. Also, by selecting the appropriate position of flexible skin 18 permits composite sheet 10 to be used in forming an automotive instrument panel having an integrated airbag door that utilizes the hinge function of composite sheet 18 as the airbag door hinge.

Decorative layers 20 and 22 are applied to first and second surfaces 14 and 16 respectively by any known technique, for example, lamination, adhesive bonding, and the like. Decorative layers 20 and 22 are formed from a thermoplastic film of, for example, polyvinyl chloride, polyolefin, thermoplastic polyester, thermoplastic elastomer, or the like. In another embodiment, decorative layers 20 and/or 22 are a multilayered structure that includes a foam core formed from, for example, polypropylene, polyethylene, polyvinyl chloride, polyurethane, and the like. A fabric is bonded to the foam core, for example, woven fabrics made from natural and synthetic fibers, organic fiber nonwoven fabric after needle punching or the like, raised fabric, knitted goods, flocked fabric and the like. In another embodiment the fabric is bonded to the foam core with a thermoplastic adhesive, including pressure sensitive adhesives and hot melt adhesives, for example, polyamides, modified polyolefins, urethanes and polyolefins.

Figure 3:
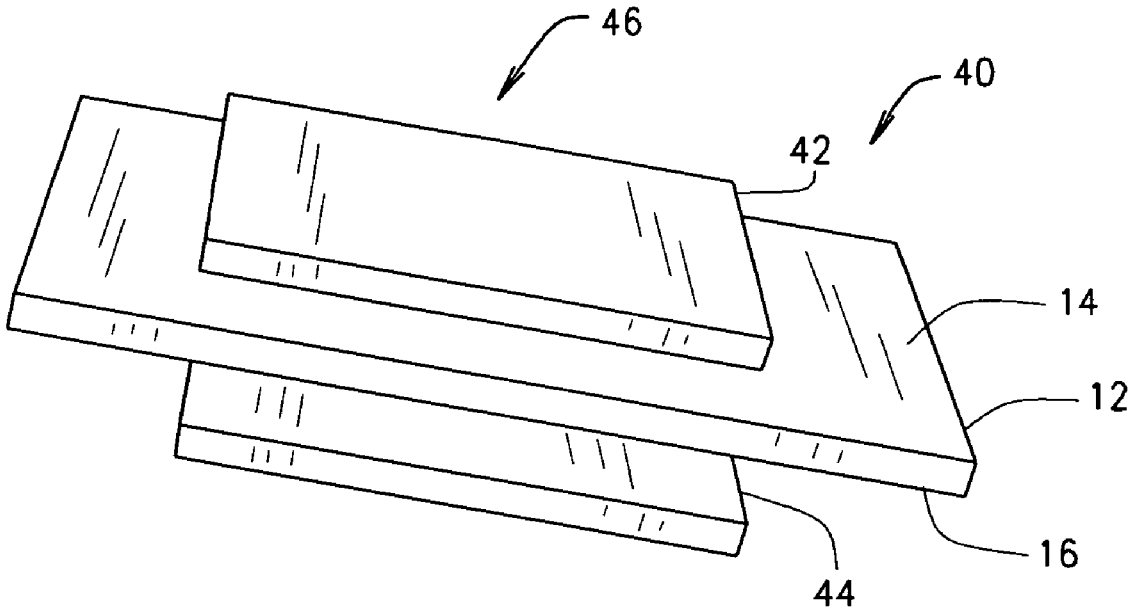
FIG. 3 is an exploded perspective schematic illustration of another embodiment of a composite thermoplastic sheet.

FIG. 3 is an exploded perspective schematic illustration of a composite thermoplastic sheet 40 in another exemplary embodiment. Composite sheet 40 is similar to composite sheet 10, and includes a core 12 having a first surface 14 and a second surface 16 as described above. Composite thermoplastic sheet 40 includes a first flexible sheet 42 laminated to first surface 14 of a core 12, and a second flexible sheet 44 laminated to second surface 16 of core 12. First flexible sheet 42 and second flexible sheet 44 are aligned to define a hinge area 46 in composite sheet 40. Composite sheet 40, in alternate embodiments, similar to composite sheet 10 described above, can include one or more decorative layers 20 (shown in FIGS. 1 and 2) as described above.

The composite thermoplastic sheets described above can be used in, but not limited to, the automotive, transportation, leisure, construction, and agricultural vehicle industries. The composite thermoplastic sheets can be molded into various articles, for example, loadfloors, parcel trays, and airbag areas, using methods known in the art including, for example, pressure forming, thermal forming, thermal stamping, vacuum forming, compression forming, and autoclaving. The integrated hinge function of the above described composite thermoplastic sheets permit the composite sheets to be thermoformed with deep draw sections, and saves part and investment costs over the products currently being used.

While the invention has been described in terms of various specific embodiments, those skilled in the art will recognize that the invention can be practiced with modification within the spirit and scope of the claims.

What is claimed is:

1. A composite thermoplastic sheet comprising:

a permeable core layer comprising a plurality of reinforcing fibers bonded together with a first thermoplastic material, said core layer having a first surface and an opposing second surface, and comprising about 20 weight percent to about 80 weight percent reinforcing fibers; and a flexible elastomeric skin laminated to and covering at least a portion of said first surface of said core layer, said portion of said first surface of said core layer covered by said flexible elastomeric skin defining a hinge area, said flexible elastomeric skin comprising an elastomeric material having a tensile modulus less than about 2500 Mpa and a tensile elongation of greater than about 50 percent before failure.

2. A composite thermoplastic sheet in accordance with claim 1 further comprising a flexible skin laminated to and covering at least a portion of said second surface of said core layer.

3. A composite thermoplastic sheet in accordance with claim 1 wherein said first thermoplastic material is selected from the group consisting of polyolefins, polyamides, polystyrene, acrylonitrylstyrene, butadiene, polyesters, polybutyleneterachlorate, polyvinyl chloride, polyphenylene ether, polyphenylene oxide, polyether imide, polycarbonates, polyestercarbonates, acrylonitrile-butylacrylate-styrene polymers, polybutyleneterephthalate, polyethyleneteraphthalate, amorphous nylon, and mixtures thereof.

4. A composite thermoplastic sheet in accordance with claim 1 wherein said elastomeric is material selected from the group consisting of thermoplastic elastomers, thermoplastic urethanes, silicones, polypropylene, polyethylene, polycarbonates, and mixtures thereof.

5. A composite thermoplastic sheet in accordance with claim 1 further comprising at least one decorative outer layer.

6. A composite thermoplastic article formed from a composite thermoplastic sheet having a hinge area, said composite thermoplastic article comprising;

a permeable core layer comprising a first thermoplastic material and a plurality of reinforcing fibers, said core layer having a first surface and an opposing second surface; and a hinge area comprising a first flexible elastomeric skin laminated to at least a portion of said first surface of said core layer, said first flexible elastomeric skin comprising an elastomeric material having a tensile modulus less than about 2500 Mpa and a tensile elongation of greater than about 50 percent before failure.

7. A composite thermoplastic article in accordance with claim 6 wherein said hinge area further comprises a second flexible elastomeric skin laminated to at least a portion of said second surface of said core layer, said second flexible elastomeric skin aligned with said first flexible elastomeric skin, said second flexible elastomeric skin comprising said elastomeric material.

8. A composite thermoplastic article in accordance with claim 6 wherein said first thermoplastic material is selected from the group consisting of polyolefins, polyamides, polystyrene, acrylonitrylstyrene, butadiene, polyesters, polybutyleneterachlorate, polyvinyl chloride, polyphenylene ether, polyphenylene oxide, polyether imide, polycarbonates, polyestercarbonates, acrylonitrile-butylacrylate-styrene polymers, polybutyleneterephthalate, polyethyleneteraphthalate, amorphous nylon, and mixtures thereof.

9. A composite thermoplastic article in accordance with claim 6 wherein said elastomeric material is selected from the group consisting of thermoplastic elastomers, thermoplastic urethanes, silicones, polypropylene, polyethylene, polycarbonates, and mixtures thereof.

10. A composite thermoplastic article in accordance with claim 6 further comprising at least one decorative outer layer.

11. A composite thermoplastic article in accordance with claim 6 wherein said core layer comprises about 20 weight percent to about 80 weight percent reinforcing fibers.

12. A composite thermoplastic article in accordance with claim 6 wherein said core layer has a density of about 0.2 gm/cc to about 1.8 gm/cc.

13. A composite thermoplastic article in accordance with claim 1 wherein said core layer has a density of about 0.2 gm/cc to about 1.8 gm/cc.

* * * * *